United States Patent [19]

Wilt

[11] Patent Number: 4,570,550

[45] Date of Patent: Feb. 18, 1986

[54] WATER COOLED DOOR

[75] Inventor: Morgan L. Wilt, Manchester, Conn.

[73] Assignee: Combustion Engineering, Inc., Windsor, Conn.

[21] Appl. No.: 753,839

[22] Filed: Jul. 11, 1985

[51] Int. Cl.[4] ..... F23M 5/08; F23M 7/04

[52] U.S. Cl. ..... 110/180; 122/498

[58] Field of Search ..... 110/173 R, 180; 122/498

[56] References Cited

U.S. PATENT DOCUMENTS 2,477,161 7/1949 Ausland et al. ..... 122/498

2,513,626 7/1950 Corriston ..... 122/498

2,673,533 3/1954 Robinson ..... 110/173

*Primary Examiner*—Edward G. Favors

*Attorney, Agent, or Firm*—Edward L. Kochey, Jr.

[57] ABSTRACT

A water cooled door (10) for a slagging furnace include a casing (16), an insulating layer (24) and a refractory layer (42). A tube panel (28) is embedded in the furnace side (12) of the refractory and carries studs (50), (52), and (54) on the furnace side of the tubes. Some of the studs (50), (54) of adjacent tubes are internested. Molten slags is solidified and retained by the studs to protect the refractory.

4 Claims, 5 Drawing Figures

WATER COOLED DOOR

BACKGROUND OF THE INVENTION

This invention relates to water cooled furnace doors and in particular to such a door for use in a slagging furnace.

When supplying an access door for a furnace, it must of course, be able to tolerate high furnace temperatures. Certain furnaces including most of in which coal is burned operate under slagging conditions. Molten ash forms on the walls on the furnace at least at the general location of the burner elevation. This slag can cause erosion and corrosion of refractory material located in the slagging zone of the furnace.

Various furnace door constructions such as those shown in U.S. Pat. No. 2,534,747 (H. W. Wilson et al) and U.S. Pat. No. 2,547,204 (R. B. Groetzinger) have cooled the refractory portion of a furnace door by routing water cooled tubes through the refractory. Such designs make it possible for the doors to operate for longer times at higher furnace temperatures.

In a slagging furnace however, it has been found that the molten slag tends to erode and corrode the refractory material leading to an unacceptable frequency of repair or replacement. Accordingly, there is a need for a door which will operate satisfactorily for extended periods in such a slagging environment.

SUMMARY OF THE INVENTION

In accordance with the invention a layer of insulation material is placed adjacent to the outer casing of the furnace door. On the furnace side of this, there is a refractory layer with water cooled tubing forming a panel and being embedded in this refractory at the furnace side thereof. Metal studs are welded to the tubes and extend toward the furnace side for the purpose of freezing slag thereon, which then prevents the erosion and corrosion of the refractory material. This protection of the refractory material is further enhanced where the studs are angled toward the adjacent tubes and internested so that increased freezing of the slag is obtained between the tubes and better retention of the frozen slag between the tubes is obtained. This protects the particularly vulnerable section of the refractory material located between the water cooled tubes.

DESCRIPTION OF THE PREFERRED EMBODIMENT

Figure 2:
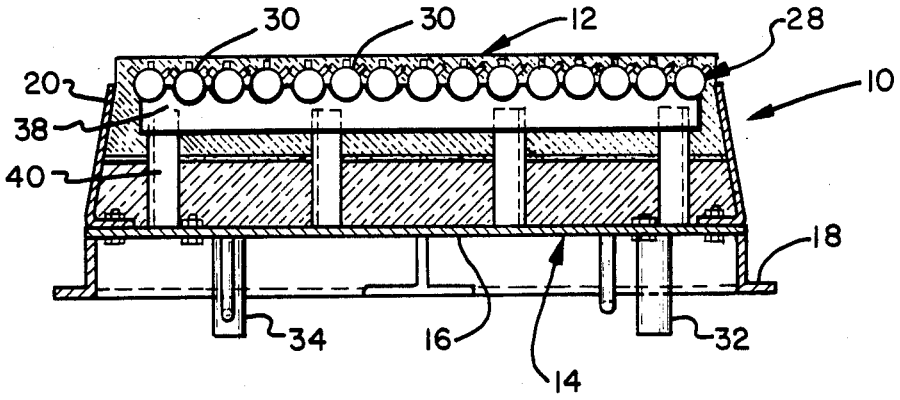
FIG. 2 is a sectional plan view through the door.

The water cooled door indicated generally as 10 has a furnace side 12 and a casing side 14. An outer casing 16 on the casing side in the form of a steel plate is stiffened by angle iron framework 18. A peripheral retainer plate 20 is peripherally bolted around the casing plate and extends inwardly toward the furnace side. One end plate 22 of this retainer is left off during the initial phases of construction of the door but installed prior to use of the door.

Immediately adjacent to the casing, is a layer insulating material 24 such as vermiculate insulation which covered with a polyethylene film 26 before pouring refractory.

Figure 1:
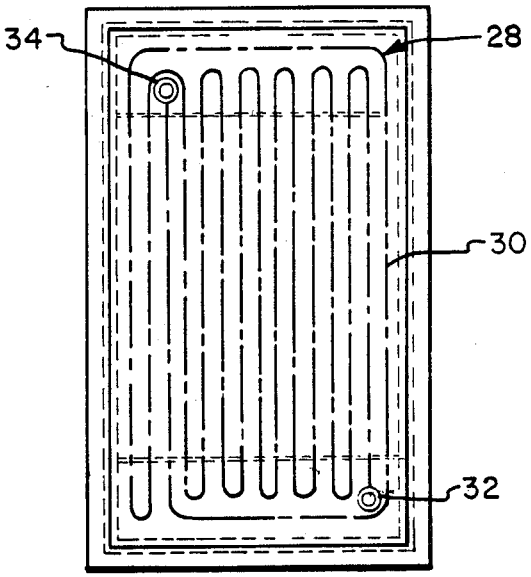
FIG. 1 is an elevation view of the furnace door showing the water cooled tube flowpath.

A tube panel 28 is comprised of a plurality of parallel water cooled tubes 30 which are serially connected to form a water flowpath as illustrated in FIG. 1. These could be 1½inch tubes on 2 inch centers. A tubular inlet 32 and tubular outlet 34 are provided for connection of the tube panel to the water source and discharge. The tubes of the panel are welded to scalloped bars 36 and 38 which are in turn welded to support angles 40 which are welded to the casing 16.

After the tube panel is secured in place, a refractory material 42 such as castable refractory, low iron, alumina-silica is poured through the open end of the retainer, and the portion 22 of the retainer thereafter installed in place. A portion of the refractory material adjacent to the retainer portion 22 must be added after the installation thereof.

The tube panel is embedded in the refractory in the furnace side thereof. While it is preferable that a slight amount of refractory exist on the furnace side of the panel, this is not essential.

Figure 4:
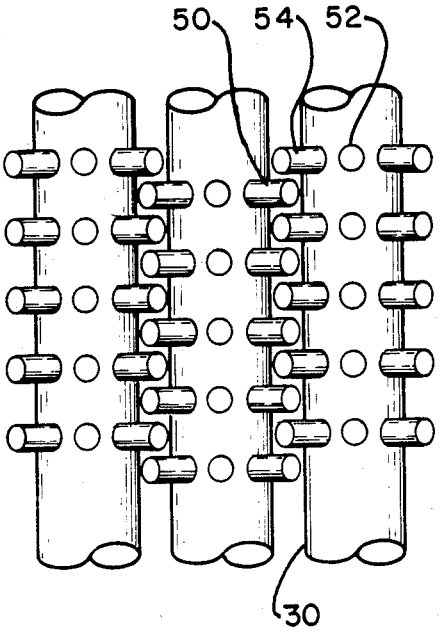
FIGS. 4 and 5 are detailed views of the studs on the water cooled tubes.
Figure 5:
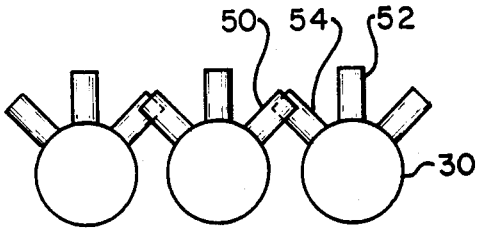
Figure 3:
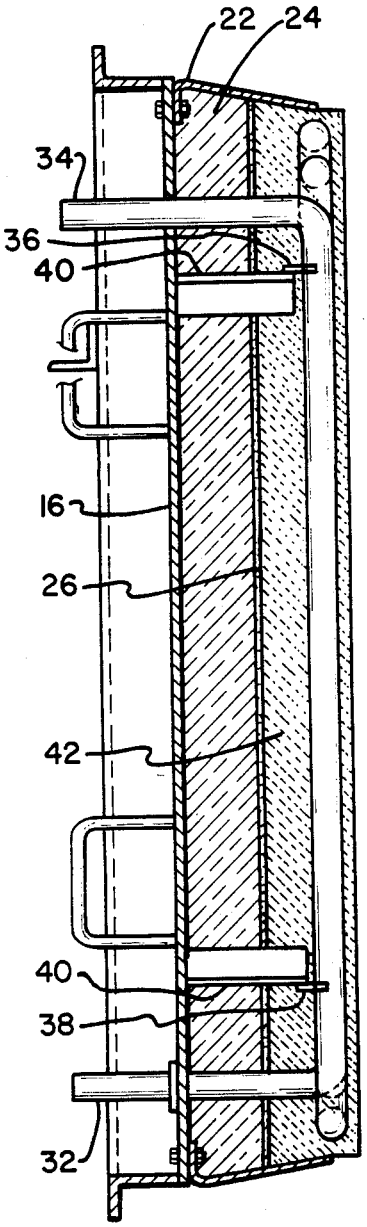
FIG. 3 is a sectional elevation through the door.

FIGS. 4 and 5 show the studs 50, 52 and 54 which are welded to tubes 30. Studs 52 are oriented to be perpendicularly to the plane of the tube panel while studs 50 and 54 are located extending at an acute angle which respect to the plane of the tube panel. It can be seen that studs 50 and 54 on the adjacent tubes are at different axially locations and are internested. Such studs could be 0.38 inch diameter with one inch axial spacing, and 0.75 inches long.

These studs being welded to water cooled tubes are in turn cooled with a good heat flowpath from the stud into the tube. The studs also have substantial surface exposed to the surrounding volume and accordingly are quite efficacious in transferring heat from any slag in that volume into the tube. They accordingly are effective to solidify or freeze any molten slag coming from the furnace. This slag being solidified can no longer erode or attack the refractory material.

The refractory material is intended to protect the insulating material from disintegration, but in this harsh environment the refractory material itself is subject to attack. In accordance with this invention, the slag layer is frozen to, in turn protect the refractory from the deleterious effects of the molten slag. If there where initially no refractory on the furnace side of these tubes, the slag layer would buildup around the studs. If however, some refractory material were located on the furnace side, it would be expected to erode away and thereafter be replaced by the solidified slag. The studs should be sufficiently long to provide some internesting between those of adjacent tubes. Should the studs be overly long, they will simply burn back until they are of a length which will survive in the environment.

I claim:

1. A water cooled door for a slagging furnace comprising:

said door having a casing side and a furnace side;

an outer casing on the casing side;

a peripheral retainer around the circumference of said outer casing and extending towards the furnace side;

a layer of insulating material adjacent to said casing and within said peripheral retainer;

a refractory layer of refractory material adjacent to said insulating material;

a tube panel comprised of a plurality of parallel water cooled tubes embedded in the furnace side of said refractory layer, and serially connected to form a water flow path; and a multiplicity of metal studs welded to and extending from said tubes toward the furnace side, whereby slag is solidified around said studs for the purpose of protecting said refractory.

2. A door as in claim 1:

including as least a portion of said studs on each tube extending at an acute angle with respect to the plane of said tube panel toward the adjacent tube;

said studs on adjacent tubes being at different axial locations and internested, whereby increased solidification and retention affects are obtained between said tubes for the purpose of protection the refractory at that location.

3. A water cooled door for a slagging furnace comprising:

said door having a casing side and a furnace side;

an outer casing on the casing side;

a peripheral retainer around the circumference of said outer casing and extending towards the furnace side;

a refractory layer of refractory material adjacent to said casing and within said peripheral retainer;

a tube panel comprised of a plurality of parallel water cooled tubes embedded in the furnace side of said refractory layer, and serially connected to form a water flow path; and a multiplicity of metal studs welded to and extending from said tubes toward the furnace side, whereby slag is solidified around said studs for the purpose of protecting said refractory.

4. A door as in claim 3:

including as least a portion of said studs on each tube extending at an acute angle with respect to the plane of said tube panel toward the adjacent tube;

said studs on adjacent tubes being at different axial locations and internested, whereby increased solidification and retention affects are obtained between said tubes for the purpose of protection the refractory at that location.

* * * * *